United States Patent [19]

Kataumi

[11] Patent Number: 4,899,614

[45] Date of Patent: Feb. 13, 1990

[54] PEDAL PAD

[75] Inventor: Yoshimasa Kataumi, Kosai, Japan

[73] Assignee: Fujikiko Kabushiki Kaisha, Fed. Rep. of Germany

[21] Appl. No.: 264,255

[22] Filed: Oct. 27, 1988

[30] Foreign Application Priority Data

Oct. 28, 1987 [JP] Japan ..... 62-164780[U]

[51] Int. Cl.[4] ..... G05G 1/14

[52] U.S. Cl. ..... 74/560; 74/563; 24/459; 24/543; 403/397

[58] Field of Search ..... 74/560, 513, 561, 563; 403/397, 399, 405.1, 353, 373, 69, 70, 71, 13; 24/543, 459, 487, 559; 248/74.3, 74.4, 74.1, 74.2

[56] References Cited

U.S. PATENT DOCUMENTS

| | | | |
|---|---|---|---|
| 1,146,146 | 7/1915 | Fisher | 74/560 |
| 3,679,249 | 7/1972 | Hoffmann | 403/69 |
| 3,715,934 | 2/1973 | Reed | 74/560 |
| 4,118,838 | 10/1978 | Schiefer et al. | 24/459 X |
| 4,356,740 | 11/1982 | Kubo et al. | 74/560 |
| 4,386,752 | 6/1983 | Pavlak et al. | 24/543 X |
| 4,669,156 | 6/1987 | Guido et al. | 248/74.3 X |

FOREIGN PATENT DOCUMENTS

| | | | |
|---|---|---|---|
| 2446133 | 4/1975 | Fed. Rep. of Germany | 248/74.3 |
| 2363687 | 5/1975 | Fed. Rep. of Germany | 248/74.3 |
| 1559036 | 3/1969 | France | 24/459 |
| 2240480 | 3/1975 | France | 74/560 |
| 2442366 | 11/1978 | France . | |
| 57-189228 | 11/1982 | Japan . | |
| 1147914 | 4/1969 | United Kingdom . | |
| 1350571 | 4/1974 | United Kingdom | 248/74.4 |

*Primary Examiner*—Rodney M. Lindsey
*Attorney, Agent, or Firm*—Thomas & Kennedy

[57] ABSTRACT

To facilitate the assembly work of a pedal pad (e.g. accelerator pad) to a pedal arm and further to increase the strength of the pedal arm, the pedal pad comprises an arm end holding portion formed integral with the pedal base plate for holding an end of the pedal arm; and an arm clasping portion composed of a U-shaped arm clasping base portion formed integral with the base plate for clasping the pedal arm and a bow-shaped arm securing cover portion for covering the arm clasping base portion to further secure the pedal arm, in cooperation with the U-shaped arm clasping base portion, into hooking engagement with said arm clasping base portion. The arm securing cover portion can be formed integral with or separate from the pedal base plate.

2 Claims, 5 Drawing Sheets

PEDAL PAD

BACKGROUND OF THE INVENTION

1. Field of the Invention

The present invention relates to a pedal pad and more specifically to an improvement in structure of a pedal pad such as an accelerator pedal pad for an automotive vehicle.

2. Description of the Prior Art

For instance, in the case of an accelerator pedal for an automotive vehicle, a resin pedal pad is fixed to an end of a pedal arm extending downward to near the vehicle body floor. When the accelerator pedal pad is depressed by the foot of a driver, the pedal arm is pivoted to control acceleration operation of the vehicle.

FIG. 1 shows an example of prior-art accelerator pedal pads. In the drawing, the pedal pad 1 is formed with a pair of arm rod supporting portions 3 and a pair of arm end holding portions 5 on the reverse side of a pedal base plate 1A. On the other hand, a pedal arm 2 is bent into an L-shape at a bent portion 2*a*. To fix the pedal pad 1 to the pedal arm 2, a bent end of the arm 2 is passed through holes formed in the arm end holding portions 5 and a straight portion of the pedal arm 2 is sandwiched between the arm rod supporting portions 3. Further, a pin 4 is passed through holes formed in both the arm rod supporting portions 3 and the pedal arm 2 so as to extend perpendicular to the axial direction of the pedal arm 2. Further, the pedal pad 1 is manufactured by molding synthetic resin, and a plurality of grooves are formed on the surface of the pedal pad 1 for prevention of foot slip.

In the above-mentioned prior-art pedal pad 1, since the pedal arm 2 is fixed to the pedal base plate 1A by use of a pin 4, there exist some problems in that a relatively high machining precision is required to form a through hole along the radial direction of the pedal arm 2 and further the assembly work of the pedal pad 1 to the pedal arm 2 is not easy. In more detail, in case the hole through which the pin 4 is passed is formed being offset from the axial center (i.e. diametral position) of the pedal arm 2, since a difference in wall thickness is produced on both the sides of the through hole, the strength of the pedal arm 2 is reduced. Therefore, when a great shock is applied to the pedal arm 2, the pedal arm 2 may be broken. To overcome this problem, a relatively large diameter rod material has been used for the pedal arm 2. Further, since the reverse side of the pedal pad 1 cannot be seen well from the pedal surface side, the insertion of the pin 4 into the through hole formed in the pedal arm 2 is not easy in assembly process.

SUMMARY OF THE INVENTION

With these problems in mind, therefore, it is the primary object of the present invention to provide an improved pedal pad which can be fixed to a relatively small diameter pedal arm by a simple assembly work without reducing the strength of the pedal arm rod.

To achieve the above-mentioned object, a pedal pad attached to a pedal arm, according to the present invention comprises: (a) a pedal base plate; (b) an arm end holding portion formed integral with said pedal base plate, for holding an end of the pedal arm; and (c) an arm clasping portion including: (1) an arm clasping base portion formed integral with said base plate, for clasping the pedal arm; and (2) an arm securing cover portion for covering said arm clasping base portion to further secure the pedal arm into hooking engagement with said arm clasping base portion.

The arm securing cover portion is formed integral with or separate from the pedal base plate.

The arm clasping base portion is a U-shaped projection formed with a hollow arm seat portion at the outer thereof. The outside inward ends of the U-shaped projection are chamfered for providing an easy insertion of the pedal arm into the hollow arm seat portion and the outside outward ends of the U-shaped projection are formed with hook engagement portions.

In the first embodiment of the present invention, the arm securing cover portion is a bow-shaped member having a hinge portion connected integral with the base plate. The central inside portion of the bow-shaped member is fitted to between the two chamfered portions of the U-shaped projection of the arm clasping base portion for securing the pedal arm into the hollow arm seat portion. An end of the bow-shaped member and the hinge portion are formed with hooked portions so as to be brought into hooking engagement with the hook engagement portions of the arm clasping base portion.

In the second embodiment of the present invention, the arm securing cover portion is a bow-shaped member formed separated from the base plate. A central inside portion of the bow-shaped member is fitted to between the two chamfered portions of the U-shaped projections of the arm clasping base portion for securing the pedal arm into the hollow arm seat portion. Both ends of the bow-shaped member are formed with hooked portions so as to be brought into hooking engagement with the hook engagement portions of the arm clasping base portion.

In the pedal pad according to the present invention, in assembly process, an end of the pedal arm is inserted into the arm end holding portion; the pedal arm is pushed into the hollow arm seat portion of the arm clasping base portion through between the chamfered portions; and the arm securing cover portion is pivoted or pushed into hooking engagement with the arm clasping base portion with the hooked portions of the cover portion engaged with the hook engagement portions of the base portion. Therefore, it is possible to simply fix the pedal pad to the pedal arm without use of an insertion pin.

BRIEF DESCRIPTION OF THE DRAWINGS

The features and advantages of the pedal pad according to the present invention over the prior-art pedal pad will be more clearly appreciated from the following description of the preferred embodiments of the invention taken in conjunction with the accompanying drawings in which.

DETAILED DESCRIPTION OF THE PREFERRED EMBODIMENTS

With reference to the attached drawings, a first embodiment of the pedal pad according to the present invention will be described hereinbelow.

Figure 1:
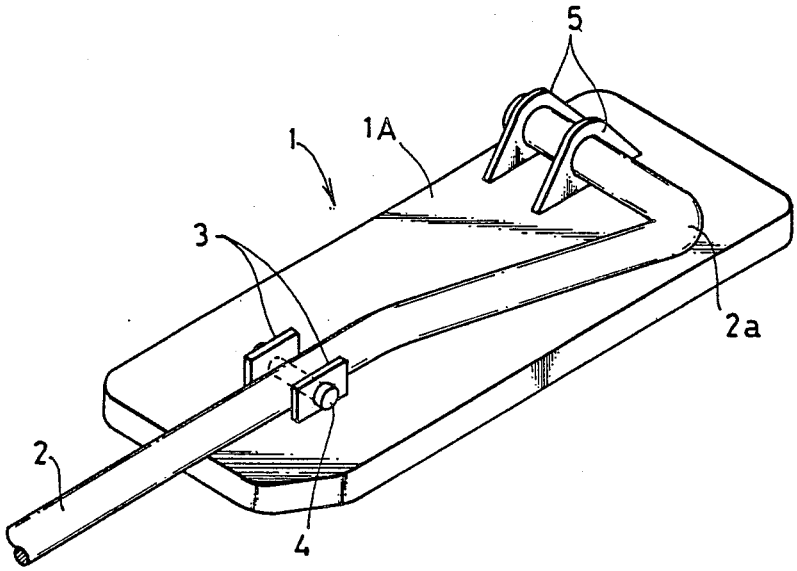
FIG.1 (PRIOR ART)
FIG. 1 is a perspective view showing the reverse side of a prior-art pedal pad, for assistance in explaining the prior-art assembly condition of the pedal pad and the pedal arm.
Figure 2:
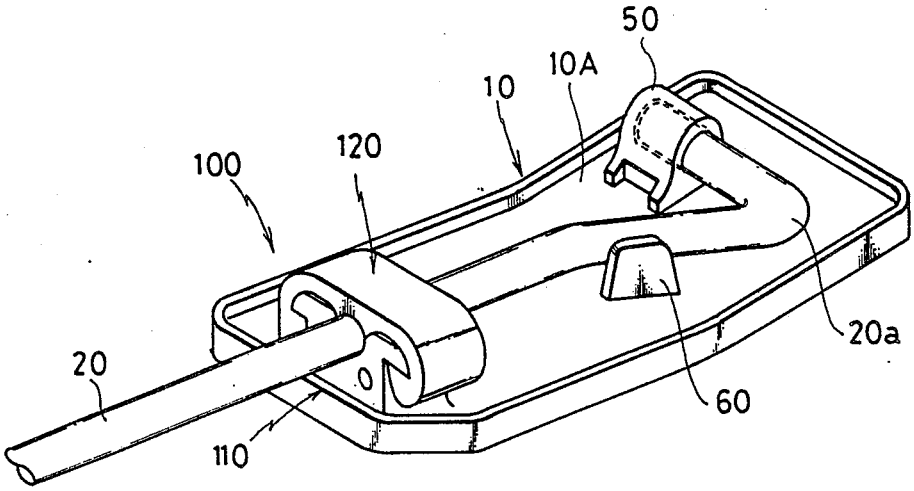
FIG. 2 is a perspective view showing the reverse side of a first embodiment of pedal pad according to the present invention for assistance in explaining the assembly condition of the pedal pad and the pedal arm.

FIG. 2, a pedal pad 10 manufactured by molding synthetic resin such as polypropylene is formed with a pedal base plate 10A, an arm end holding portion 50, an arm side stopping portion 60, and an arm clasping portion 100 composed of an arm clasping base portion 110 and an arm securing cover portion 120.

The arm end holding portion 50 is formed near a corner of the pedal base plate 10A so as to hold an end of the pedal arm 20 bent at a bent portion 20*a*. The arm side stopping portion 60 is formed at roughly the middle of the pedal base plate 10A. The arm clasping portion 100 is formed near an end of the pedal base plate 10A on the side remote from the arm end holding portion 50. The above-mentioned arm end holding portion 50, the arm side stopping portion 60 and the arm clasping portion 100 are all formed integral with the pedal base plate 10A on the reverse side of the pedal pad 10.

Figure 3A:
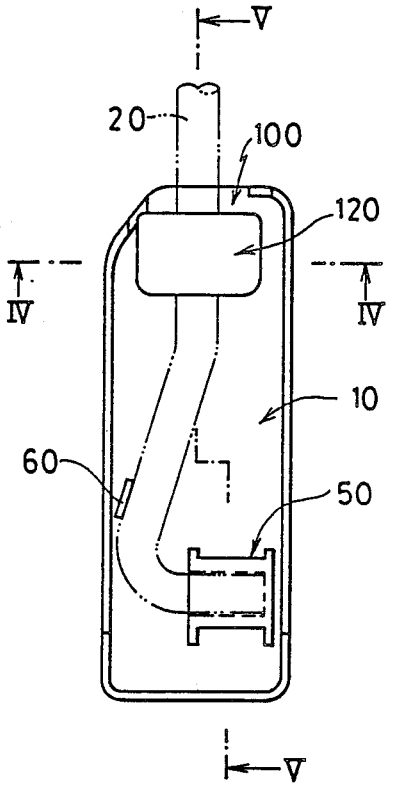
FIG. 3(A) is a rear view showing the reverse side of the pedal pad shown in FIG. 2.
Figure 3B:
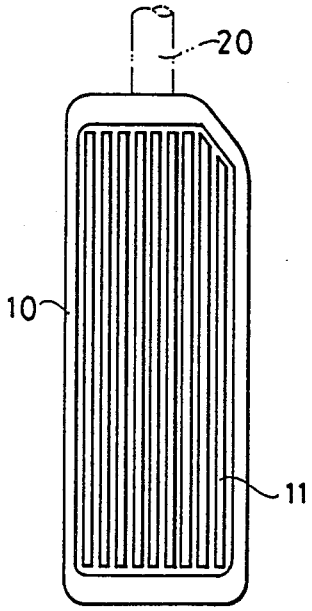
FIG. 3(B) is a front view showing the front side of the pedal pad shown in FIG. 2.

FIG. 3(A) shows the reverse side of the pedal pad 10, in which a pedal arm 20 is fixed by the above-mentioned three arm holding, stopping and clasping portions 50, 60 and 100. Further, FIG. 3(B) shows the front side of the pedal pad 10, in which a plurality of grooves 11 are formed along the longitudinal direction thereof for prevention of foot slip.

Figure 4A:
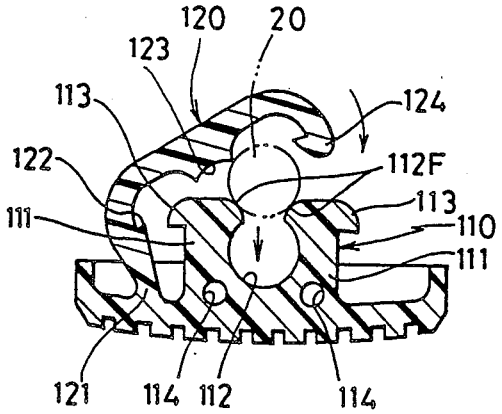
FIG. 4(A) is an enlarged cross-sectional view showing an arm clasping portion, in which the arm securing cover portion is disengaged from the arm clasping base portion.

The arm clasping portion 100 will be described in further detail with reference to FIGS. 4(A) and (B). The arm clasping base portion 110 is formed into a roughly U-shape in cross section with two projections 111. A hollow arm seat portion 112 of roughly circular shape is formed between the two projections 111 so as to clasp the pedal arm 20 when inserted thereinto. The two projections 111 are chamfered at the outside inward ends 112F for providing an easy insertion of the circular pedal arm 20 into the hollow arm seat portion 112. On the other hand, the two projections 111 are formed with two hook engagement portions 113 at the outside outward ends for providing hooking engagement with the arm securing cover portion 120. Further, two cylindrical hollow portions 114 are formed in the arm clasping base portion 110 in order to increase elasticity in the projections 111 and prevent material depression on the surface of the pedal pad during and after molding process.

The arm securing cover portion 120 is formed into roughly a bow-shaped in cross section and connected integral with the base plate 10A at a hinge portion 121. Further, the bow-shaped member is formed with an arcuate inside portion 123 fitted to between the two chambered portions 112F of the U-shaped projections 111 to secure the pedal arm into the hollow arm seat portion 112, and a hooked portion 122 near the hinge portion 121 and another hooked portion 124 at an end of the bow-shaped member so as to be brought into hooking engagement with the hook engagement portions 113 of the arm clasping base portion 110. Further, the diameter of a circular formed by the hollow arm seat portion 112 and the arcuate inside portion 123 is determined a little smaller than that of the pedal arm 20. Further, the wall thickness of the hinge portion 121 is determined a little thinner than those of other portions. However, it is also possible to form the hinge portion 121 by forming a V-shaped cutout at the hinged portion 121 for providing an easy pivotal motion of the bow-shaped arm securing cover portion 120.

When the pedal pad 10 is to be fixed to the pedal arm 20, first an end of the pedal arm 20 is inserted into the arm end holding portion 50; secondly the pedal arm 20 is pushed into the hollow arm seat portion 112 of the arm clasping base portion 110 through the chamfered portions 112F with the pedal arm rod near the bent portion 20*a* brought into contact with the arm side stopping portion 60; thirdly the arm securing cover portion 120 now being kept open is pivoted into closed condition around the hinged portion 121 until the hooked portion 124 of the arm securing cover portion 120 is firmly engaged with the hook engagement portion 113 of the arm clasping base portion 110. As described above, the pedal arm 20 is firmly fixed between the arm clasping base portion 110 and the arm securing cover portion 120 in hooking engagement condition. After the pedal arm 20 has been firmly clasped by the arm clasping portion 100 as shown in FIG. 4(B), when the pedal arm 20 is moved in the upward direction, since the projection portions 111 are pushed toward both the outward directions (the right and left directions), the two hook engagement portions 113 are more tightly engaged with the two hooked portions 122 and 124 of the arm securing cover portion 120.

Further, since the arm securing cover portion 120 is formed integral with the pedal pad 10, if the arm securing cover portion 120 is rotated counterclockwise around the hinge portion 121, the cover portion 120 will not be disengaged from the arm clasping base portion 110, because the hooked portion 124 is more tightly engaged with the hook engagement portion 113.

Figure 4B:
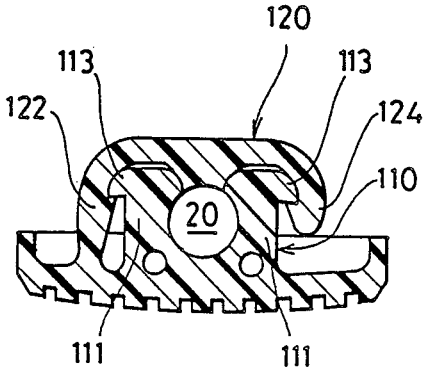
FIG. 4(B) is a similar enlarged cross-sectional view showing the arm clasping portion, in which the arm securing cover portion is engaged with the arm clasping base portion.
Figure 5:
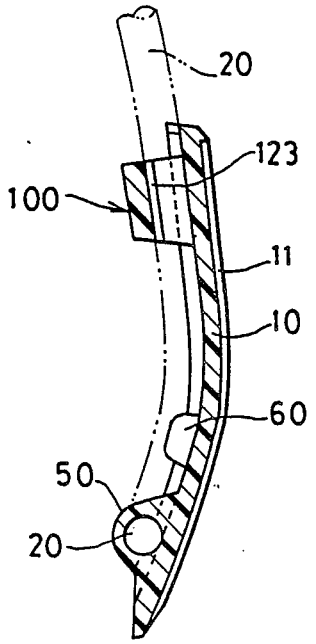
FIG. 5 is a longitudinal cross-sectional view of the pedal pad shown in FIG. 2.

Further, when the pedal arm 20 is moved in the horizontal direction in FIG. 4(B), since each of the projection portions 111 is bent toward the outward direction, at least one of hook engagement portions 113 is more tightly engaged with at least one of the hooked portions 122 and 124 of the arm securing cover portion 120, so that the arm securing cover portion 120 will not be disengaged from the arm clasping base portion 110.

Figure 6:
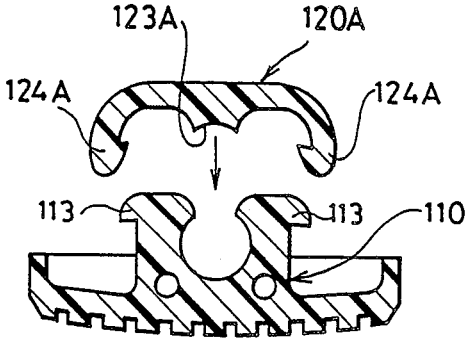
FIG. 6 is an enlarged cross-sectional view showing another embodiment of the pedal pad according to the present invention.

FIG. 6 shows a second embodiment of the present invention. In this embodiment, an arm securing cover portion 120A is not formed integral with the pedal base plate 10A, but separated therefrom. That is, this arm securing cover portion 120A is formed into a roughly bow-shape in symmetry with respect to the center thereof as shown in FIG. 6. In this second embodiment, there exist advantages in that the molding die can be manufactured easily and therefore the molding die cost is low. Further, in this second embodiment, it is possible to obtain substantially the same effect as in the first embodiment.

As described above, in the pedal pad according to the present invention, since the pedal pad 10 is formed with the arm clasping portion 100 composed of the arm clasping base portion 110 for clasping the pedal arm 20 in the hollow arm seat portion 112 and the arm securing cover portion 120 for firmly covering the arm clasping base portion 110 under hooking engagement conditions, it is possible to simplify the assembly work of the pedal pad 10 to the pedal arm 20. Further, since no pin is used as in the prior-art pedal pad, it is possible to reduce the number of the parts. Further, since it is unnecessary to form a through hole (into which a pin is inserted) in the pedal arm 20, it is possible to minimize the diameter of the pedal arm 20 or to increase the strength of the pedal arm 20.

What is claimed is:

1. A pedal pad attached to a pedal arm, which comprises:

(a) a pedal base plate;

(b) an arm end holding portion formed integral with said pedal base plate, for holding an end of the pedal arm; and (c) an arm clasping portion including:

(1) an arm clasping base portion formed integral with said base plate, for clasping the pedal arm, said arm clasping base portion being a U-shaped projection formed with a hollow arm seat portion at the center thereof and having outside inward and outside outward ends, said outside inward ends of the U-shaped projection being chamfered for providing an easy insertion of the pedal arm into the hollow arm seat portion and said outside outward ends of the U-shaped projection being formed with hook engagement portions;

(2) an arm securing cover portion for covering said arm clasping base portion to further secure the pedal arm into hooking engagement with said arm clasping base portion, said arm securing cover portion being a bow-shaped member having a hinge portion integral with the base plate, an arcuate central inside portion of the bow-shaped member being adapted to fit between the two chamfered portions of the U-shaped projection of said arm clasping base portion for securing the pedal arm into the hollow arm seat portion, the distal end of the bow-shaped member having a hook portion and a second hook portion adjacent the hinge portion, said hook portions being adapted to be brought into hooking engagement with the hook engagement portions of said arm clasping base portion; and (d) an arm side stopping portion formed integral with said pedal base plate at a roughly middle portion thereof.

2. A pedal pad attached to a pedal arm, which comprises:

(a) a pedal base plate;

(b) an arm end holding portion formed integral with said pedal base plate, for holding an end of the pedal arm; and (c) an arm clasping portion including:

(1) an arm clasping base portion formed integral with said base plate, for clasping the pedal arm, said arm clasping base portion being a U-shaped projection formed with a hollow arm seat portion at the center thereof and having outside inward and outside outward ends, said outside inward ends of the U-shaped projection being chamfered for providing an easy insertion of the pedal arm into the hollow arm seat portion and said outside outward ends of the U-shaped projection being formed with hook engagement portions; and (2) an arm securing cover portion for covering said arm clasping base portion to further secure the pedal arm into hooking engagement with said arm clasping base portion, said arm securing cover portion being a bow-shaped member having two ends with hooked portions and formed separate from the pedal base plate, a central inside portion of the bowshaped member being adapted to fit between the two chamfered portions of the U-shaped projections of said arm clasping base seat portion for securing the pedal arm into the hollow arm seat portion, said hooked portions of said bow-shaped member being adapted to be brought into hooking engagement with the hook engagement portions of said arm clasping base portion; and (d) an arm side stopping portion formed integral with said pedal base plate at a roughly middle portion thereof.

* * * * *